US011067239B1

(12) United States Patent
Xu

(10) Patent No.: US 11,067,239 B1
(45) Date of Patent: Jul. 20, 2021

(54) LIGHTING DEVICE SIMULATING LIGHT EFFECT OF CANDLE FLAME

(71) Applicant: POWER BEAUTY INDUSTRIAL CO., LTD., DongGuan (CN)

(72) Inventor: Yiqun Xu, DongGuan (CN)

(73) Assignee: POWER BEAUTY INDUSTRIAL CO., LTD., Guangdong (CN)

( * ) Notice: Subject to any disclaimer, the term of this patent is extended or adjusted under 35 U.S.C. 154(b) by 0 days.

(21) Appl. No.: 17/011,353

(22) Filed: Sep. 3, 2020

(30) Foreign Application Priority Data

Apr. 20, 2020 (CN) ..... 202020600662.3
Apr. 30, 2020 (CN) ..... 202010371218.3
Apr. 30, 2020 (CN) ..... 202020719159.X

(51) Int. Cl.

| | |
|---|---|
| ***F21S 10/04*** | (2006.01) |
| ***F21V 23/00*** | (2015.01) |
| ***H01F 7/06*** | (2006.01) |
| ***F21V 14/08*** | (2006.01) |
| ***F21V 1/14*** | (2006.01) |

(52) U.S. Cl.
CPC ..... *F21S 10/046* (2013.01); *F21V 1/146* (2013.01); *F21V 14/08* (2013.01); *F21V 23/006* (2013.01); *H01F 7/064* (2013.01)

(58) Field of Classification Search
CPC ..... F21S 10/046
USPC ..... 362/392
See application file for complete search history.

(56) References Cited

U.S. PATENT DOCUMENTS 9,664,348 B1 * 5/2017 Chen ..... F21S 6/001

* cited by examiner

*Primary Examiner* — Sean P Gramling
(74) *Attorney, Agent, or Firm* — Michael X. Ye; Morris, Manning & Martin, LLP

(57) ABSTRACT

The present disclosure relates to a lighting device simulating visual effect of candle flame includes an immovable assembly and a movable assembly. The immovable assembly has a stationary supporting structure for holding a light source in position. The movable assembly has a light-effect component for simulating visual effect of natural flame at a candle wick. The movable assembly further includes at least a part of a driving component accommodated in the supporting structure. The part of the driving component and the light-effect component of the movable assembly are such connected to each other that when the part of the driving component moves positively and/or is driven to move passively, at least a part of the light-effect component performs swing movement. The lighting device thus can simulate naturally flickering or dancing flame of a burning candle, thereby creating lighting effect and atmosphere as those provided by a real candle.

6 Claims, 2 Drawing Sheets

LIGHTING DEVICE SIMULATING LIGHT EFFECT OF CANDLE FLAME

This application claims the benefit of China Patent Application No. 202020600662.3 filed on Apr. 20, 2020, China Patent Application No. 202010371218.3, filed on Apr. 30, 2020, and China Patent Application No. 202020719159.X, filed on Apr. 30, 2020 which is incorporated by reference herein in its entirety.

FIELD

The present invention relates to lighting equipment and more particularly to a lighting device simulating visual effect of candle flame.

DESCRIPTION OF RELATED ART

A traditional candle has a main body made of paraffin and a wick in the form of a cotton thread. By burning the wick with fire, the paraffin is consumed to keep the flame and illuminate. Such a candle ends its life when paraffin is exhausted. Traditional candles thus have the following shortcomings: first, paraffin is a fossil product and generates by-product sulfur-containing gas when burnt, making use of candles unpleasing to users, unfriendly to the environment and unfavorable to energy preservation. In addition, the naked flame of candles tends to cause fire accidents and is thus dangerous. As to lighting efficiency, since candle flame is dim and likely to die out in wind) environments, candles are not perfect for outdoor applications or where the lighting demand is high. Due to limits in terms of material and production technique, candles have limitations in both size and lighting effect. Moreover, the melted paraffin not fully consumed is not reusable and requires special treatment, causing additional waste of resources.

To address the shortcomings of traditional candles, there have been some LED-based electric candle lamps that use light-emitting diodes (LEDs) and thus enjoy the advantages of versatile use, long service life, and environmental friendliness. Most of the existing candle lamps employ swinging reflective components to reflect light and thereby simulate flickering flame of a burning candle. For example, China Patent No. CN205655127U discloses an LED candle lamp that comprises an LED board equipped with LEDs centrally and peripherally, a condensing lens and a reflecting lens. The condensing lens serves to condense the light from the LEDs of the LED board onto the reflecting lens. The reflecting lens serves to reflect the condensed LED light outward the LED candle lamp in an angled, downward direction. While the prior-art candle lamp does enhance lighting efficiency with the lenses, it simulates the traditional candle merely with a flame-shaped lamp lampshade, making it poor in simulating naturally flickering and dancing flame of a burning candle flame in terms of lighting effect and atmosphere creation.

Additionally, there are also candle lamps using a swinging light-transmitting member to simulate flame of a burning candle. For example. China Patent No. CN109578924A discloses an electronic candle lamp that includes a vertically installed outer tube, a top plate fixed to the top of the outer tube, a first hole formed in the top plate, a fixing tube that is vertically installed to be within the outer tube and received in the first hole, a fixing plate fixed to the top of the fixing tube, a second hole formed in the fixing plate, a bracket fixed to the fixing plate so that its upper part stands out the second hole and its lower part is fixed in the fixing tube, an LED lamp fixed to the top of the bracket and electrically connected to a PCB, a light-transmitting member vertically installed above the LED lamp, a connecting member through which the light-transmitting member has its bottom fixedly connected to a pendulum that is fixed in the fixing tube, and a magnet that is fixed to the bottom of the pendulum so that it is opposite to and separated from an electromagnetic coil. The LED lamp is received in a bore formed in the light-transmitting member. When the light-transmitting member is lit by the light from the LED lamp while swinging to and fro, consumers can see the complete flame shape from any angle of view, thereby simulating flickering flame of a burning candle better. The light-transmitting member swings against a pivot arranged on the LED lamp. Since the electronic candle lamp continuously swings during its use, the long working hours can lead to premature failure of the LED lamp as the critical component, thereby undesirably limiting the service life of the electronic candle. Additionally, the center of gravity of the light-transmitting member that is staying still is off the plumb line on which the LED lamp is located, and this prevents the light-transmitting member from symmetrical swing movement. Consequently, the eccentric swing movement makes the candle lamp poor in simulating flickering flame.

SUMMARY OF THE INVENTION

In view of the shortcomings of the prior art, the present disclosure provides a lighting device, comprising an immovable assembly and a movable assembly, the immovable assembly having a stationary supporting structure for holding a light source in position; the movable assembly having a light-effect component for simulating visual effect of flame at a candle wick, the movable assembly further comprises at least a part of a driving component accommodated by the supporting structure, wherein the part of the driving component and the light-effect component of the movable assembly are such connected to each other that when the part of the driving component moves positively and/or is driven to move passively, at least a part of the light-effect component performs swing movement. According to the design of the present disclosure, the immovable assembly and the movable assembly accommodate the driving component through the supporting structure so as to obtain a mechanism that is highly compact and reliable in terms of movement. In this case, the lighting device could be closed to form an independent unit, which serves as a modularized assembly component of other lighting equipment, so as to generate a candle light effect in appropriate occasions. The configuration that the driving device is arranged in the immovable assembly simplifies limitation on the range of circumferential movement, so that it is not necessary to precisely set up the power supply, which is helpful for reducing cost. Moreover, as the movable assembly carries a part of the driving component itself, when the light-effect component simulating the candle wick and the driving component are separated in structure as well as in power supply, the movable assembly could perform the swing movement without a transmittal mechanism, thereby significantly improving work reliability. Particularly such devices tend to tilt and turn over because of their small size (typically 2 to 4 centimeters), traditional plastic transmission gears turn over easily and interrupt the transmission path, thus losing the swing ability. To sum up, that the movable assembly of the present disclosure directly connects the driving device is more compact, safer and easier to control.

Preferably, the light-effect component comprises a hollow, non-opaque, strip-shaped lampshade mounted around the light source, so as to form an internally-lit strip-shaped light source, in which the lampshade is connected to a fixing member that serves to hold the part of the driving component in position. Since the light source is lit internally and the lampshade with a three-dimensional shape cooperates with it, a much authentic candlewick effect can be achieved, that is, a center at the lower inside is the brightest, and a distal end along the length direction is the dimmest. The lampshade therefore could have a corresponding light-reflecting or light-enhancing structure.

Preferably, when the lampshade and the fixing member are assembled together to form a unity, they are suspended to the supporting structure by means of an elastic member, so that the lampshade of the light-effect component is allowed to perform the swing movement with respect to the supporting structure. By combining the lampshade and the movable assembly into a unity, a transmission mechanism can be spared, thus improving reliability.

Preferably, the part of the driving component is fixed to one end of the movable assembly that is far from the light source. One of the two parts of the driving device is a permanent magnet, the other part is a coil. The structural design of the present disclosure allows interchangeable arrangement of the coil and the permanent magnet, and also allows cooperation of multiple permanent magnets and multiple coils.

Preferably, the supporting structure for accommodating the part of the driving component provides the part of the driving component with a peripheral wall for defining a movement range. In this way, a control unit can be spared, and over-swinging can be avoided with simple pulsed power supply.

Preferably, the part of the driving component accommodated by the supporting structure is fixed to the fixing member, the fixing member not only connects the elastic member atop, but also supports the lampshade at the top, thereby allowing the lampshade to follow movement transmitted to the fixing member by the part of the driving component and to perform the swing movement with respect to the supporting structure. The swing movement does not pass any transmission mechanism, especially tractive elements, gears and spring elements are avoided, thereby improving reliability greatly and making the structure more compact.

Preferably, the part of the driving component performs varied movement in response to an electromagnetic field of a coil that changes over time, and the varied movement is transmitted to the lampshade that is detachably supported on top of the fixing member through the fixing member that is suspended to the supporting structure by means of the elastic member. The change of the coil over time can be regular, or can be randomly set. The lampshade and the immovable assembly are both suspended to a single elastic member, forming a tumbler-like swing body. The lampshade and the immovable assembly could both be suspended to three elastic members arranged as a triangle, forming a swing body only capable of slight swing. The lampshade and the immovable assembly could both be suspended to a plurality of elastic members, forming a swing body with greater damping.

Preferably, the movable assembly is such suspended to the supporting structure by means of the elastic member that when staying still in idleness, the lampshade of the movable assembly is in an upright position. When The lampshade and the immovable assembly are both suspended to a single elastic member so as to form a tumbler-like swing body, an upright position is the common position itself, and a candle shape of achieved when not lit. In prior art, unlit candlewick is normally in a tilted position.

Preferably, the movable assembly has a center of gravity that is located around or below an only suspending point. The arrangement of the center of gravity is helpful for the recovery after swing. The center of gravity can be determined according to the length of the leg fixing the lampshade to the immovable assembly.

Preferably, the elastic member is of a strip-like shape in vertical direction, so that when the elastic member has an upper end thereof suspended to a lamp board of the supporting structure and has a lower end thereof hanging the fixing member, the elastic member allows the fixing member carrying the lampshade to performs 3600 free movement in the movement range defined by the supporting structure that accommodates the part of the driving component.

According to the present invention, by controlling power supply to provide the coil connected to the coil power supply branch with pulsed power supply, the coil correspondingly generates a varied magnetic field to drive the magnet to perform varied movement. The magnet drives the fixing member that is connected to it to swing against at least one elastic member as the pivot. The fixing member can then transmit the swing movement to the lampshade connected thereto. At this time, the elastic member performs torsional deformation or elastic deformation and generates a reverse torsional or elastic force. When power supplied to the coil is cut off, the reverse torsional or elastic force of the elastic member drives the lampshade to swing reversely. When the lampshade swings reversely to a certain angle, the gravitational potential energy of the lampshade and the torsional deformation or elastic deformation potential energy of the elastic member jointly generate a restoring force, which drives the lampshade to swing again. When the torsional force of the elastic member is exhausted after repeated driving operation, the coil is powered again to generate a magnetic field to drive the lampshade to swing again, thereby achieving repeated swing movement. By combining intermittent driving and elastic potential energy, the resulting swing movement can provide more realistic visual effect resembling naturally flickering flame.

According to another aspect of the present invention, the present invention further provides a lighting device that simulates visual effect of candle flame. Particularly, the present invention provides an LED candle lamp, at least comprising an immovable assembly and a movable assembly, immovable assembly at least comprising supporting structure. The movable assembly has its parts hung above and below the light source on the supporting structure. The driving component acts in response to the interaction between the magnet or the coil and the electromagnetic field between the magnet and the coil over time. The movable assembly having the magnetic material or coil at its one side displaces with respect to supporting structure against the suspending point as the pivot in an irregular pattern over time, thereby causing the side of the movable assembly opposite to the side having the part of the driving component to add the light emitted by the light source installed on the supporting structure with dynamics, making the light like dynamic candle flame. Therein, the center of gravity of the movable assembly that is staying still is on the plumb line in which the light source is located.

Preferably, the driving component has a magnet and a coil that are arranged opposite to each other. The coil is connected to the power source through the power cord so as to form a magnetic field that changes over time and interacts with the magnet.

Preferably, the immovable assembly further comprises a light source, a lamp board, a bracket, a motherboard, a bottom cover, a power cord and a light source power cord. The movable assembly includes a lampshade, an elastic member, a fixing member and a magnet. The coil on the motherboard is powered by the pulsed power supply through the power cord to generate lines of magnetic force, thereby exerting a pushing force on the magnet positionally off from it. With the elastic member hung below the lamp board, when the coil exerts the intermittent force on the magnet inside the fixing member, the lampshade swings. Through insertion connection, the lampshade and the fixing member are vertically secured above and below the lamp board, so that the fixing member swings with respect to the lamp board against the elastic member as the pivot under the intermittent force generated by the coil acting on the magnet inside the fixing member, thereby providing visual effect like that of a flickering flame at a candle wick.

Preferably, the power cord passes through the hole of the bottom cover and gets connected to the motherboard, thereby forming a coil power supply branch and a lighting power supply branch. Therein, the coil power supply branch connected to the coil through the motherboard provides the coil on the motherboard with intermittent power supply, so that when the line of magnetic force generated by the coil drives the magnet to perform intermittent movement, the lampshade swings to stimulate flickering flame. The light source power cord passes through the hole of the bottom cover and gets connected to the motherboard and in turn the lighting power supply branch of the power cord, thereby continuously powering the light source and allowing the wick to keep illuminating while swinging.

Preferably, the magnet is a columnar magnet.

Preferably, the bracket has a round inner tube.

Preferably, the lampshade is an assembled structure including an upper part that allows light to pass therethrough and a lower part that reflects light.

Preferably, the first end of the elastic member is provided with a T-shaped portion configured to combine the lamp board so that the movable assembly can be inserted into a hole provided on the lamp board from above.

Preferably, the lighting device is configured to be mounted on a lamp body. The first hole formed on the second end of the lamp body is a countersunk variable-diameter hole for accommodating the reflector of the lampshade. The lateral wall defining the first hole has a curved surface that matches the curved surface of the outer lateral wall of the reflector.

Preferably, the lighting device is lit through the following steps.

In Step S1, the coil on the motherboard 8 is powered in a pulsed manner through the power cord.

In Step S2, the coil generates a pulsed magnetic field, thereby generating a pushing force acting on the magnet opposite to the coil.

In Step S3, the pushing force drives the fixing member hung below the lamp board through the elastic member and fixed to the magnet and/or the coil to move.

In Step S4, the movement of the fixing member drives the lampshade that is opposite to the magnet at the other side of the lamp board to swing with respect to the lamp board against the elastic member as the pivot.

Moreover, the present invention has the following technical benefits:

(1) The lighting device provides lighting that simulates naturally flickering flame of a burning candle flame, thereby helping to create romantic atmosphere without using naked flame and in turn eliminating the risk of fire accidents, while being advantageously long in service life and odor free.

(2) Since the light of the lighting device is evenly scattered into the ambient space through the curved peripheral surface of the lampshade 1, the overall lighting effect can be improved, and resembles the natural flicker of real-world flame better without compromising the overall lighting effect.

(3) The elastic member acting as the swing pivot can deform to preserve energy during the swing movement, thereby continuously providing a driving force in the interval between the periods where the driving component powers the lighting device. Meanwhile, the elastic member acts as a buffer, so that the swing movement of the lampshade 1 resembles the natural flicker of real flame better.

DETAILED DESCRIPTION OF THE INVENTION

Figure 1:
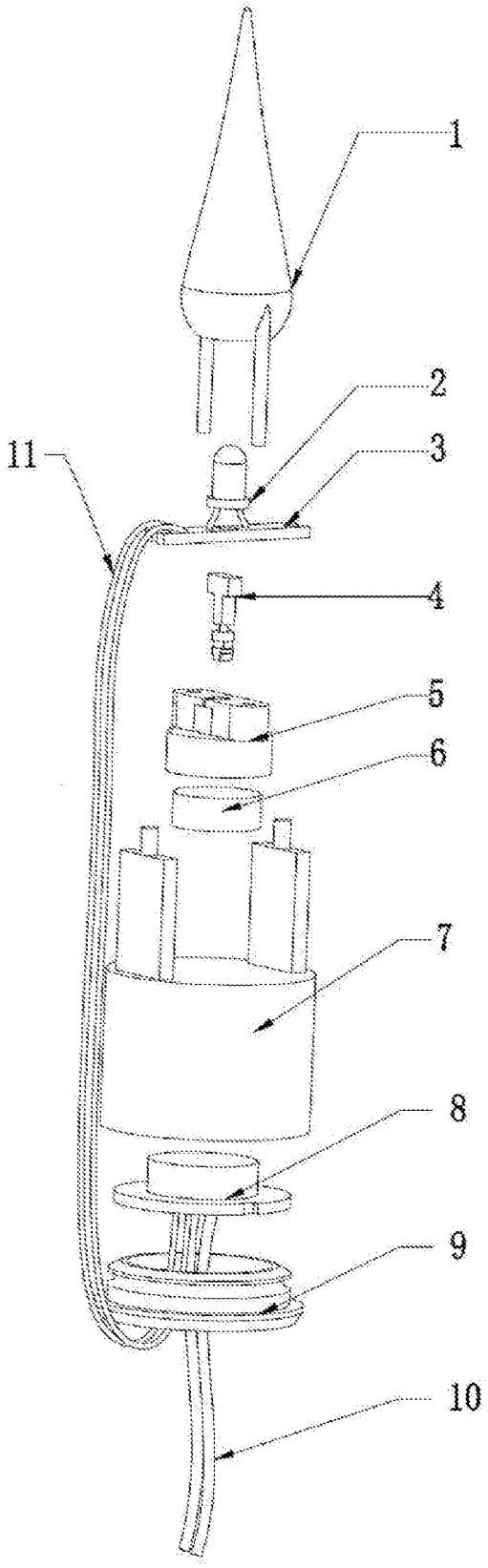
FIG. 1 is an exploded view of a wick of a lighting device of the present invention.
Figure 2:
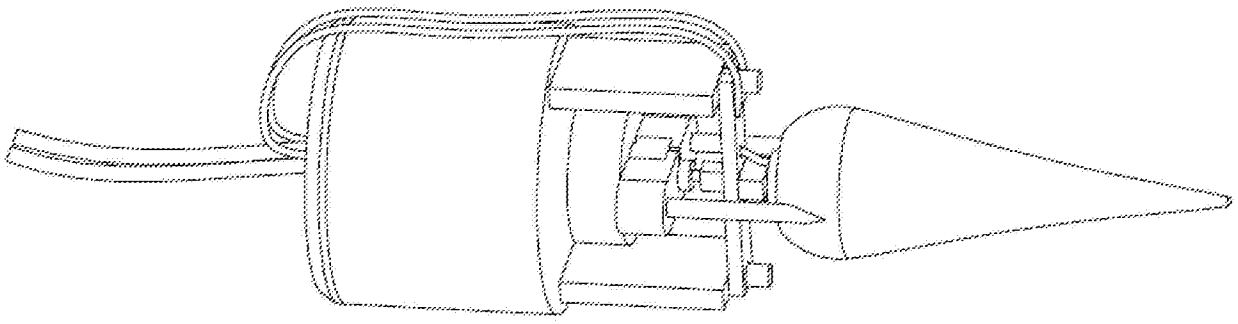
FIG. 2 is a perspective view of the wick of the lighting device of the present invention.

Please refer to FIGS. 1 and 2 in which a lighting device simulating visual effect of candle flame according to the present invention is depicted. As shown, the lighting device is an LED candle lamp comprising an immovable assembly and a movable assembly.

The immovable assembly includes a stationary supporting structure, such as a lamp board 3, for holding a light source in position. The immovable assembly includes a lamp board 3, a bracket 7, a motherboard 8 and a bottom cover 9. The lamp board 3 has fixing holes (or arc holes) symmetrically arranged at its two ends that are configured to fittingly receive posts correspondingly provided on the bracket 7, so as to secure the lamp board 3. The bottom cover 9 retains the motherboard 8 in the space defined by the bracket 7. Preferably, the motherboard 8 may be fit in and secured by the bottom cover 9.

The supporting structure is composed of the lamp board 3, the bracket 7 and the bottom cover 9. Therein, the lamp board 3 is positioned atop to hold the light source, and the bracket 7 is in the middle to accommodate a driving component, while the bottom cover 9 is positioned at the bottom to close the entire lighting device. In other words, the bottom cover 9 supports the motherboard 8 by closing the opening of the accommodating chamber defined by the bracket 7. The bracket 7 has its lower columnar wall defining the chamber that accommodates the driving component. The lamp board 3 is retained by the posts on the bracket 7. Preferably, the posts of the bracket 7 are each of a columnar structure. The posts are installed on a pair of opposite rectangular plates of the bracket 7. The central axes of the posts are parallel to the central axis of the bracket 7. The posts are configured to such combined with the fixing holes (or arc holes) of the lamp board 3 that the lamp board 3 abuts against the laterals of the plates, thereby supporting and securing the lamp board 3 horizontally.

The movable assembly includes a light-effect component for simulating visual effect of flame at a candle wick and at least a part of a driving component, e.g. magnet 6, that is accommodated by a supporting structure, i.e. the bracket 7. The part of the driving component, i.e. the magnet 6, may be connected to and the light-effect component of the movable assembly at, for example, a lampshade 1, so that when the part of the driving component, i.e. the magnet 6, moves positively and/or is driven to move passively, the lampshade 1 performs swing movement. The movable assembly may be composed of the lampshade 1, an elastic member 4, a fixing member 5 and the magnet 6. The lampshade 1 has at least one pin extending downward that is configured to be inserted into the fixing member 5, so that the lampshade 1 and the fixing member 5 are combined into a unity. The fixing member 5 may contain therein the magnet 6 or a coil. The unity formed by the lampshade 1 and the fixing member 5 is hung on the lamp board 3 by means of the elastic member 4. The magnet 6 or coil, in response to changes of its magnetic field, generates a driving force that pushes the unity formed by the lampshade 1 and the fixing member 5, and makes the unity formed by the lampshade 1 and the fixing member 5 perform swing movement with respect to the lamp board 3 against the elastic member 4 that hangs the unity. This swing movement causes more realistic flame-flickering effect thanks to the combination of the magnetic force of the magnet 6 or coil, the elastic potential energy of the elastic member 4 and the gravitational potential energy of the movable assembly.

The light source 2 may be an LED lamp or another suitable lighting structure. The light source 2 is fixed to the lamp board 3. The light source 2 is lifted form the lamp board 3 by fixed legs, so that its light-emitting portion is positioned within the lampshade 1. The power cord 10 is connected to motherboard 8 and includes a lighting power supply branch and a coil power supply branch. The light source 2 is connected to the lighting power supply branch on the motherboard 8 through an LED light source power cord 11, and the lighting power supply branch is connected to the power source through the power cord 10 on the motherboard 8. Power is continuously supplied through the lighting power supply branch for consistent lighting. The coil on the motherboard 8 is connected to power source through the coil power supply branch on the motherboard 8, and the lighting power supply branch is connected to power source through the power cord 10 on the motherboard 8. The coil power supply branch provides intermittent power supply so as to stimulate flickering flame.

Therefore, the driving component comprises at least two parts, one of which is composed of the fixing member 5 and the magnet 6 as shown fixed to the lower end of the movable assembly, and the other of which is the coil located below and separate from the magnet 6. In other words, the driving component comprises the magnet 6 and the coil opposite to each other. The magnet 6 is installed at the bottom of the fixing member 5, and the coil opposite thereto may be installed below it on the motherboard 8. The motherboard 8 may be further fixed to the bottom cover 9. Alternatively, in an opposite arrangement, the magnet 6 is installed on the bottom cover 9, while the coil is installed on the fixing member 5. In either of the foregoing alternative arrangements, the coil is connected to the power source through the power cord 10 so as to form a magnetic field that changes over time and interacts with the magnet 6.

The light-effect component is composed of the lampshade 1 and the light source 2 located within it. The lampshade 1 can move with respect to the light source 2 when driven by the elastic member 4, the fixing member 5 and the magnet 6. The lampshade 1 is connected to the fixing member 5 (by means of, for example, insertion, snapping or screwed connection), so that the lampshade 1 and the fixing member 5 jointly form a unity. The fixing member 5 contains therein the magnet 6. The unity formed by the lampshade 1 and the fixing member 5 is hung on the lamp board 3 by means of the elastic member 4. The magnet 6, in response to changes of the magnetic field, generates a force that pushes the unity formed by the lampshade 1 and the fixing member 5, so that the unity formed by the lampshade 1 and the fixing member 5 swings with respect to the lamp board 3 against the elastic member 4 that hangs it, thereby providing lighting effects like flickering flame. For the arrangement where the magnet is stationary and the coil is connected to the movable assembly, the operation as described previously also applies.

The light-effect component is formed by inserting the light source into the lampshade 1 from below. The light source 2 is preferably of a strip-like shape to be well received in the also strip-like lampshade 1. The combination of the strip-like shape light source and the strip-like lampshade provides the maximum intensity of illumination at the lower central part of the light-effect component, and the light fading out from the lower central part to the periphery and in an axial direction. Such light effect is more close to that of a candle wick even in s static state, with the degree of simulation significantly higher than that of a reflector-based candle wick. The light-effect component may be hung on the lamp board 3 by means of the elastic member 4. The light source 2 may be accommodated in the lampshade 1 of the light-effect component. When the light-effect component performs swing movement against the elastic member 4 that is now acting as a pivot for suspension, the lampshade 1 may perform swing movement with respect to the light source 2. By swinging against the light source 2 accommodated therein, the light-effect component can deflect the light emitted by the light source 2, thereby simulating lighting effect of a candle wick.

In the mode of positive movement, when the coil is subject to a changing current, it generates a changing magnetic field. The magnet 6, when exposed in the changing magnetic field, generates a pushing force to push the fixing member 5 to perform swing movement against the elastic member 4 that is acting as the hanging post. The lampshade 1 is combined with the fixing member 5 into a unity by means of insertion. During the swing movement of the fixing member 5, the lampshade 1 performs swing movement against the elastic member 4 as the pivot for suspension in a direction opposite to the flickering direction of the fixing member 5. The driving force generated by the coil pushes the light-effect component to positively swing.

In the mode of passive movement, when the current flowing through the coil is zero, it stops generating the changing magnetic field. Consequently, the magnet 6, now not affected by the magnetic field, stops generating the positive pushing force and thus stop pushing the fixing member 5 to swing against the elastic member 4 as the pivot for suspension. The unity formed by the lampshade 1 and the fixing member 5 after the foregoing swing movement has left its initial stable state. At this time, the lampshade 1 and the fixing member both act to return the initial stable state, thereby pushing the unity formed by the lampshade 1 and the fixing member 5 to continue to passively swing against the elastic member 4 as the pivot for suspension.

The positive movement and the passive movement jointly simulate the behavior of real flame at candle wick that flickers with flowing air, i.e. movement of an irregular pattern.

Compared to the conventional approach that uses the combination of a motor and a transmission mechanism, the present invention realized an improved strategy of manipulating the positive and passive modes without using any control unit and complicated power supply systems.

In the present invention, the coil is powered by the pulsed power supply through the power cord 10 to generate lines of magnetic force, thereby exerting a pushing force on the magnet 6 opposite to it. The fixing member 5 hung below the lamp board 3 by means of the elastic member 4 is in turn affected by the pushing force through the magnet 6 which it is fixed to. As a result, the fixing member 5 swings against the suspending point. Then when the coil (or magnet 6) receives the pushing force, the lampshade 1 and the magnet 6 (or the coil) that are vertically positioned above and below the lamp board 3, respectively, both generate intermittent swing movement. Since the lampshade 1 is inserted into the fixing member 5, the lampshade 1 and the fixing member 5 jointly swing with respect to the lamp board 3 against the elastic member 4 as the suspending point generate flicker, thereby stimulating flickering flame.

Preferably, the light-effect component comprises a hollow, non-opaque, strip-shaped lampshade 1 mounted around the light source 2, so as to form an internally-lit strip-shaped light source. Therein, the lampshade 1 is connected to a fixing member 5 that serves to hold at least a part of a driving component in position. The light source 2 is fixed to the lamp board 3 of the supporting structure. The lampshade 1 is a hollow, light-transmitting structure of a strip-like shape. The light emitted by the light source 2 is scattered through the lampshade 1 that is mounted around it so as to illuminate. The lampshade 1 and the fixing member 5 are connected to each other. Being supported and secured by the fixing member 5 allows the lampshade 1 to stably receive light from the light source 2 and scatter the light.

Preferably, the lampshade 1 and the fixing member 5 are assembled to form a unity, which is suspended against the supporting structure together by means of the elastic member 4, so that the lampshade 1 of the light-effect component can swing with respect to the supporting structure. The lampshade 1 is inserted into the fixing member 5 to form a unity, so that the two components are vertically positioned above and below the lamp board 3, respectively.

Consequently, in response to the intermittent force generated by the coil and acting on the magnet 6 in fixing member 5, the fixing member 5 swings with respect to the lamp board 3 against the elastic member 4 as the pivot, thereby providing visual effect like that of a flickering flame at a candle wick. The swing direction of the side where the lampshade 1 is in is always opposite to the swing direction of the side where the fixing member 5 is in. Preferably, the unity formed by the lampshade 1 and the fixing member 5 may be suspended against the supporting structure by means of plural elastic members 4. With the plural elastic members 4, the connection of the lampshade 1 and the fixing member 5 can be ensured even when the unity is swinging, and the elastic force acting on the entire unity during the swing movement can be enhanced, thereby improving the resultant swing movement.

Preferably, the light source 2 has its one end far from the movable assembly fixed to the part of the driving component. Therein, one of the two parts of the driving component is a permanent magnet, and the other part is a coil. The magnet 6 and the coil are interchangeable in terms of position. The magnet 6 may be replaced by a different permanent magnetic member. The fixing member 5 of the immovable assembly contains a part of the driving component. Where the part of the driving component installed in the fixing member 5 is the magnet 6, the other part of the driving component is a coil. The coil is installed on and secured by the motherboard. Preferably, the coil may be fixed in the bracket 7 separately. When a force generated between the coil and the magnet 6 due to the changing magnetic field, since the coil is fixed, the magnet 6 is displaced. The magnet 6 received in the fixing member 5 pushes the fixing member to swing with respect to the lamp board 3 against the elastic member 4 as the pivot, thereby providing visual effect like that of a flickering flame at a candle wick. When the part of the driving component installed in the fixing member 5 is a coil, the other part of the driving component is a magnet 6. The magnet 6 is installed on and secured by the motherboard. Preferably, the magnet 6 may be fixed in the bracket 7 separately. When a force generated between the coil and the magnet 6 due to the changing magnetic field, since the magnet 6 is fixed, the coil is displaced. The coil received in the fixing member 5 pushes the fixing member to swing with respect to the lamp board 3 against the elastic member 4 as the pivot, thereby providing visual effect like that of a flickering flame at a candle wick.

Preferably, the supporting structure for accommodating at least a part of a driving component provides the part of the driving component with a 360° peripheral wall, for defining a movement range. The part in the supporting structure is the bracket 7. The bracket 7 has a round inner tube. Since the fixing member 5 performs 360°, random swing within the bracket 7, for ensuring that the fixing member 5 containing the part of the driving component swings smoothly without interference, the bracket 7 has therein a columnar inner tube that has a constant distance between its center and its inner wall. Preferably, the bracket 7 has an inner diameter at least greater than the maximum distance between the lateral wall of the fixing member 5 that is swinging in either direction and the plumb line of the center of gravity of the fixing member 5 that is staying still.

Preferably, the part of the driving component accommodated in the supporting structure is fixed to the fixing member 5. The fixing member 5 not only connects the elastic member 4 atop, but also supports the lampshade 1 from below, thereby allowing the lampshade 1 to follow the movement transmitted to the fixing member 5 by the part of the driving component and to perform swing movement with respect to the supporting structure. The lampshade 1 is inserted into and secured by the fixing member 5 vertically. The fixing member 5 is connected to the lamp board 3 of the supporting structure through the elastic member 4. The part of the driving component transmits the movement it transmits to the fixing member 5 the lampshade 1 in a manner that the elastic member 4 is taken as the pivot for suspension. The lampshade 1 and the fixing member 5 swing with respect to the elastic member 4.

Preferably, the part of the driving component performs varied movement that changes with an electromagnetic field of a coil over time. The varied movement is transmitted to the lampshade 1 detachably supported by the fixing member 5 through the fixing member 5 that is suspended against the supporting structure by means of the elastic member 4. The driving component comprises a magnet 6 and a coil opposite to each other. The driving component acts in response to the interaction between the magnet 6 or the coil and the electromagnetic field between the magnet 6 and the coil over time. The movable assembly having at least a part of a driving component at its one side displaces with respect to supporting structure against the suspending point as the pivot in an irregular pattern over time, thereby causing the side of the movable assembly opposite to the side having the part of the driving component to add the light emitted by the light source 2 installed on the supporting structure with dynamics, making the light like dynamic candle flame.

Preferably, the movable assembly is such suspended against the supporting structure through the elastic member 4 that when staying still in idleness, the lampshade 1 of the movable assembly is in an upright position. When the entire movable assembly constructed from the lampshade 1 and the fixing member 5 stays still, or, when it is not affected by the driving component, the axis of the lampshade 1 is perpendicular to the upper surface of the lamp board 3. At this time, the central axis of the light source 2 coincides with the central axis of the lampshade 1.

Preferably, the center of gravity of the movable assembly is located around or below an only suspending point. When staying still, the entire movable assembly constructed from the lampshade 1 and the fixing member 5 has its center of gravity located close to the center of gravity of the suspending point (or of the elastic member 4 staying still). Preferably, the center of gravity of the combination of the lampshade 1 and the fixing member 5 that is staying still is located consistent with the center of gravity of the suspending point (or of the elastic member 4 staying still). The overall state of the combination of the lampshade 1 and the fixing member 5 is in balance with respect to the elastic member 4. At this time, only a small force applied to the fixing member 5 can make the lampshade 1 start to swing, thereby improving the overall swing efficiency and reducing power consumption. Preferably, the center of gravity of the combination of the lampshade 1 and the fixing member 5 that is staying still is located below the suspending point (or the center of gravity of the elastic member 4 that stays still), and is located on a common plumb line with the suspending point, so that the lampshade 1 and the fixing member 5 as parts of the combination can swing reciprocally against the elastic member 4 as the pivot reciprocally when they power is supplied through the power cord 10 in a pulsed manner to generate line of magnetic force that exerts a pushing force on the magnet 6 that is positionally off from it. Particularly, the lampshade 1 and the fixing member 5 swing with respect to elastic member 4 in opposite directions.

Preferably, the elastic member 4 is of a strip-like shape and vertically positioned, so that when the elastic member 4 is swingably connected between the lamp board 3 and the fixing member 5. The elastic member 4 allows the fixing member 5 carrying the lampshade 1 to perform 360° free movement in the movement range defined by the supporting structure that accommodates the part of the driving component. Since the strip-like elastic member 4 has good elastic-restoring capability after torsional deformation, it can make the coil use the pushing force generated by the magnet 6 to drive the lampshade 1 to swing effectively, and can use its elastic-restoring force to facilitate reverse swing, thereby providing more realistic flickering-flame visual effect at the lampshade 1. Preferably, the elastic member 4 may be a connecting member of a strip-like shape. As used herein, the term "elastic" refers to being capable of stretching and/or compressing, without limitation. The elastic member of the present invention thus may include anything having strip-like shape and being flexible, such as a chain, a rope or a steel wire or a combination thereof.

The center of gravity of the combination of the lampshade 1 and the fixing member 5 that is staying still is located on the plumb line on which the center of gravity of the elastic member 4 that is staying still, so that the lampshade 1 and the fixing member 5 as parts of the combination can swing reciprocally against the elastic member 4 as the pivot reciprocally when they power is supplied through the power cord 10 in a pulsed manner to generate line of magnetic force that exerts a pushing force on the magnet 6 that is positionally off from it. Particularly, the lampshade 1 and the fixing member 5 swing with respect to elastic member 4 in opposite directions.

Preferably, the center of gravity of the combination of the lampshade 1 and the fixing member 5 that is staying still is located consistent with the center of gravity of the elastic member 4 stays still. The overall state of the combination of the lampshade 1 and the fixing member 5 is in balance with respect to the elastic member 4, At this time, only a small force applied to the fixing member 5 can make the lampshade 1 start to swing, thereby improving the overall swing efficiency and reducing power consumption.

Preferably, the magnet 6 is a columnar magnet. The columnar magnet facilitates ensuring that the center of gravity of the combination of the lampshade 1 and the fixing member 5 that is staying still is stably located on the plumb line on which the center of gravity of the elastic member 4 that is staying still, and also facilitates wiring of the coil arranged opposite to the magnet 6.

Preferably, the power cord 10 passes through the hole of the bottom cover 9 and gets connected to the motherboard 8, thereby forming a coil power supply branch and a lighting power supply branch. Therein, the coil power supply branch connected to the coil through the motherboard 8 provides the coil on the motherboard 8 with intermittent power supply, so that when the line of magnetic force generated by the coil drives the magnet 6 to perform intermittent movement, the lampshade 1 swings to stimulate flickering flame. The light source power cord 11 passes through the hole of the bottom cover 9 and gets connected to the motherboard 8 and in turn the lighting power supply branch of the power cord 10, thereby continuously powering the light source 2 and allowing the wick to keep illuminating while swinging. Preferably, the coil is located below the magnet 6 and electrically connected to the coil power supply branch of the motherboard 8. The distance between the coil and the magnet 6 is such set that the generated magnetic field is strong enough to drive the magnet 6 to move. The motherboard 8 may be electrically connected to the power cord 10 through a switch, and the coil generates the magnetic field to drive the magnet 6 so as to swing the lampshade 1 that is connected to fixing member 5.

Preferably, the lighting device is lit through the following steps.

In Step S1, the coil on the motherboard 8 is powered in a pulsed manner through the power cord 10.

In Step S2, the coil generates a pulsed magnetic field, thereby generating a pushing force acting on the magnet 6 opposite to the coil.

In Step S3, the pushing force drives the fixing member 5 hung below the lamp board 3 through the elastic member 4 and fixed to the magnet 6 and/or the coil to move.

In Step S4, the movement of the fixing member 5 drives the lampshade 1 that is opposite to the magnet 6 at the other side of the lamp board 3 to swing with respect to the lamp board 3 against the elastic member 4 as the pivot.

Some conventional candle lamps use a plate-based structure to reflect light and thereby visually simulate flickering flame. Such a swinging plate-based structure of the conventional candle lamp when viewed from different directions looks differently, so the resulting visual effect is not stable and realistic, and can even cause glare. In the present invention, since the light source 2 on the lamp board 3 is housed by the lampshade 1, the light emitted by the light source 2 can be scattered along the peripheral surface of the lampshade 1, thereby improving lighting and preventing glare. Through insertion connection, the lampshade 1 and the fixing member 5 are vertically secured above and below the lamp board 3, so that when the fixing member 5 swings with respect to the lamp board 3 against the elastic member 4 as the pivot under the intermittent force generated by the coil acting on the magnet inside the fixing member 5, the light source 2 illuminates while swinging, thereby simulating flickering flame of a burning candle. Since the light of the lighting device is evenly scattered into the ambient space through the curved peripheral surface of the lampshade 1, the overall lighting effect can be improved, and resembles the natural flicker of real flame better without compromising the overall lighting effect.

The existing plate-based structure is solely driven to swing by the driving component. Every swing requires the driving component to drive the plate-based structure, resulting in high power consumption. The coil on the motherboard 8 exerts a pushing force on the magnet 6 positionally off from it by using the power cord 10 to supply power in a pulsed manner, so that the fixing member 5 hung below the lamp board through the elastic member 4 and fixedly connected to the magnet 6 performs movement, thereby making the lampshade 1 opposite to the magnet 6 across the lamp board 3 swing with respect to the lamp board 3 against the elastic member 4 as the pivot. Since the elastic member 4 has good elastic-restoring capability after deformation, when the lampshade 1 swings back, the elastic member 4 can deformed reversely, thereby using the elastic-restoring force to drive the lampshade 1 again. In practice use, the lampshade 1 can do several swings without external driving force. This helps to reduce the frequency with which the coil exerts the pushing force on the magnet 6, thereby minimizing power consumption, saving energy, and lengthening battery life. As compared to the prior art, the present invention creatively uses the elastic member 4 that not only acts as a pivot against which the lampshade 1 and the fixing member 5 vertically secured above and below the lamp board 3 swing with respect to the lamp board 3 when the magnet in the fixing member 5 receives the intermittent force generated by the coil, but also deforms to preserve energy as the lampshade 1 swings, thereby swinging the lampshade 1 in the interval between the periods where the coil generates the pulsed pushing force. In addition, the elastic member 4 acts as a buffer when the lampshade 1 swings with respect to the lamp board 3 in response to movement of the fixing member 5 caused by the intermittent force the coil exerting on the magnet in the fixing member 5, so that the swing movement of the lampshade 1 resembles the natural flicker of real flame better.

Preferably, the bracket 7 has a round inner tube. Since fixing member 5 swings within the bracket 7 in a random direction that is off the plumb line of the center of gravity of the fixing member 5 that is staying still, for ensuring that the swing movement of the fixing member 5 is free from interference, the bracket 7 has therein a columnar inner tube that has a constant distance between its center to its inner wall. Preferably, the bracket 7 has an inner diameter at least greater than the maximum distance between the lateral wall of the fixing member 5 that is swinging in either direction and the plumb line of the center of gravity of the fixing member 5 that is staying still.

Preferably, the lampshade 1 is an assembled structure. Its upper part is a light-transmitting member that allows light to pass therethrough and its lower part is a reflector that reflects light. Preferably, the reflector is located corresponding to the light source 2 in the lampshade 1. The reflector allows the light emitted by the light source 2 to be maximally scattered into the environment through the light-transmitting member, thereby maximizing illumination. In addition, since the lampshade 1 swings with respect to the light source 2, the distance between the light source 2 and the inner wall of the reflector keeps changing, making the light emitted by the light source 2 cast on the inner wall of the reflector in a changing angle, and in turn causing the light reflected by the reflector to exit with a varying angle of emergence. All these contribute to the ever changing lighting effect, thereby better simulating flickering flame of a real burning candle. Preferably, the light-transmitting member may be made of a plastic material to be transparent or translucent. With the transparent or translucent light-transmitting member, the lighting device provides versatile lighting, and can be used anywhere where lighting or atmosphere creation is needed.

Preferably, the elastic member 4 has a first connecting portion at its first end for combining with the lamp board 3 to hang the movable assembly. Preferably, the first connecting portion may be a T-shaped portion configured to be inserted into a hole provided on the lamp board 3 from above. The T-shaped first connecting portion prevents the elastic member 4 from coming off the lamp board 3 during its deformation. Preferably, the elastic member 4 is made of an elastic material. For example, the elastic member 4 may be silicone. Since the elastic material has good elastic-restoring capability after torsional deformation, the resulting elastic member 4 can make the coil use the pushing force generated by the magnet 6 to drive the lampshade 1 to swing effectively, and can use its elastic-restoring force to facilitate reverse swing, thereby providing more realistic flickering-flame visual effect at the lampshade 1.

Preferably, the elastic member 4 has its second end provided with a second connecting portion for connecting the fixing member 5. The second connecting portion may have a cone-shaped end configured to be inserted into a mount hole correspondingly formed on the fixing member 5.

Preferably, the elastic member 4 has an intermediate connecting portion in its middle part for transmitting force to swing the lampshade 1. The intermediate connecting portion may be a columnar structure having a diameter at least smaller than the minimal radial size of the first connecting portion and/or the second connecting portion. With the columnar intermediate connecting portion of the elastic member 4, when the coil generates an intermittent force acting one the magnet inside the fixing member 5, the intermediate connecting portion of the elastic member 4 can have random torsional deformation or elastic deformation in a direction perpendicular to its axis, thereby simulating flicker of candle flame better.

Preferably, the lampshade 1 is of a cone-like or water-drop shape. Preferably, the lampshade 1 has a cone-like shape resembling natural flame. The first hole is sized to receive the lampshade 1.

Preferably, the pins of the lampshade 1 and the holes on the fixing member 5 form detachable connection.

Preferably, the bottom cover 9 has a ring-like structure allowing the power cord 10 to pass therethrough to connect the motherboard 8.

Preferably, the driving component and the light source 2 share a common power inlet. Preferably, the power cord 10 may be connected to an external power source (not shown). Preferably, the power cord 10 may be connected to a battery (not shown) as a power source.

Preferably, the lighting device may be mounted on a lamp body (not shown). The lamp body is a columnar member having its first end formed with a flat surface and having its second end formed with an irregular shape resembling a melted wax surface naturally formed on a real candle.

Preferably, the second end of the lamp body has a concave surface with raised periphery. In other words, the second end of the lamp body has a second end whose middle part is sunk against its periphery. Preferably, the second end of the lamp body has an undulate, wave-like periphery. Preferably, the second end of the lamp body comprises a first part having a first average height and a second part having a second average height. Therein, the first average height is greater than second average height. Preferably, the second end of the lamp body is centrally formed with a first hole. The lamp body is shaped to simulate a candle structure. Preferably, the lamp body may be regarded as a candle holder for indoor use, without limitation. However, the lamp body may be regarded as the lamp body used in the present invention as long as it is capable of supporting the lighting device. For example, the lamp body may be a solar lamp, a streetlamp and a lawn lamp for outdoor use.

Preferably, the first hole formed on the second end of the lamp body is a countersunk variable-diameter hole for accommodating the reflector of the lampshade 1. The lateral wall defining the first hole has a curved surface that matches the curved surface of the outer lateral wall of the reflector. Preferably, the curved surface of the lateral wall of the first hole matches the curved surface of the lateral wall of the reflector of the lampshade 1 that is swinging to the maximum extent. With the countersunk variable-diameter hole, the swing movement of the lampshade 1 is limited within the lamp body without interference, thereby realizing better simulation of flickering flame of a real burning candle.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A lighting device, comprising an immovable assembly and a movable assembly, the immovable assembly having a stationary supporting structure for holding a light source in position;

the movable assembly having a light-effect component for simulating visual effect of flame at a candle wick; and the lighting device being characterized in that the movable assembly further comprises at least a part of a driving component accommodated by the supporting structure, wherein the part of the driving component and the light-effect component of the movable assembly are such connected to each other that when the part of the driving component moves positively and/or is driven to move passively, at least a part of the light-effect component performs swing movement, wherein the light-effect component comprises a hollow, non-opaque, strip-shaped lampshade mounted around the light source, so as to form an internally-lit strip-shaped light source in which the lampshade is connected to a fixing member that serves to hold the part of the driving component in position, wherein when the lampshade and the fixing member are assembled together to form a unity, they are suspended to the supporting structure by means of an elastic member so that the lampshade of the light-effect component is allowed to perform the swing movement with respect to the supporting structure, wherein the movable assembly has a center of gravity that is located around or below an only suspending point, and wherein the elastic member is of a strip-like shape in vertical direction, so that when the elastic member has an upper end thereof suspended to a lamp board of the supporting structure and has a lower end thereof hanging the fixing member, the elastic member allows the fixing member carrying the lampshade to performs 360° free movement in the movement range defined by the supporting structure that accommodates the part of the driving component.

2. The lighting device of claim 1, wherein the part of the driving component is fixed to one end of the movable assembly that is far from the light source.

3. The lighting device of claim 1, wherein the supporting structure for accommodating the part of the driving component provides the part of the driving component with a peripheral wall for defining a movement range.

4. The lighting device of claim 1, wherein the part of the driving component accommodated by the supporting structure is fixed to the fixing member, the fixing member not only connects the elastic member atop, but also supports the lampshade at the top, thereby allowing the lampshade to follow movement transmitted to the fixing member by the part of the driving component and to perform the swing movement with respect to the supporting structure.

5. The lighting device of claim 1, wherein the part of the driving component performs varied movement in response to an electromagnetic field of a coil that changes over time, and the varied movement is transmitted to the lampshade that is detachably supported on top of the fixing member through the fixing member that is suspended to the supporting structure by means of the elastic member.

6. The lighting device of claim 1, wherein the movable assembly is such suspended to the supporting structure by means of the elastic member that when staying still in idleness, the lampshade of the movable assembly is in an upright position.

* * * * *